US007753729B2

(12) United States Patent
Wang

(10) Patent No.: US 7,753,729 B2
(45) Date of Patent: Jul. 13, 2010

(54) CONNECTOR WITH FASTENING TABS

(75) Inventor: Hsu-Fen Wang, Taipei Hsien (TW)

(73) Assignee: Advanced Connectek, Inc., Taipei Hsien (TW)

( * ) Notice: Subject to any disclaimer, the term of this patent is extended or adjusted under 35 U.S.C. 154(b) by 79 days.

(21) Appl. No.: 12/254,714

(22) Filed: Oct. 20, 2008

(65) Prior Publication Data

US 2009/0142964 A1 Jun. 4, 2009

(30) Foreign Application Priority Data

Nov. 30, 2007 (TW) ..... 96220378 U

(51) Int. Cl.
*H01R 13/648* (2006.01)

(52) U.S. Cl. ..... 439/607.01

(58) Field of Classification Search ..... 439/607.01, 439/607–610, 101, 108, 79, 80, 638
See application file for complete search history.

(56) References Cited

U.S. PATENT DOCUMENTS

D351,136 S * 10/1994 Kurata ..... D13/147
5,984,725 A * 11/1999 Belopolsky et al. .... 439/607.31
D465,202 S * 11/2002 Kubota ..... D13/147
7,214,096 B2 * 5/2007 Huang et al. ..... 439/607.01
7,217,159 B2 * 5/2007 Chung ..... 439/607.01
D579,876 S * 11/2008 Novotney et al. ..... D13/147
7,473,143 B2 * 1/2009 Chen ..... 439/670
D586,297 S * 2/2009 Tago et al. ..... D13/147
7,618,268 B2 * 11/2009 Ko et al. ..... 439/101
2002/0086581 A1 * 7/2002 Chen et al. ..... 439/607
2006/0154524 A1 * 7/2006 Huang et al. ..... 439/607
2007/0218762 A1 * 9/2007 Liao et al. ..... 439/607
2008/0242133 A1 * 10/2008 Herlitz et al. ..... 439/166

* cited by examiner

*Primary Examiner*—Alexander Gilman
(74) *Attorney, Agent, or Firm*—Kolisch Hartwell, PC

(57) ABSTRACT

A connector has an insulative housing, a plurality of terminals and a metal shell. The insulative housing has a base and a tongue formed on the base. The terminals are mounted in the insulative housing. The metal shell covers the insulative housing and has a top, a space and a plurality of fastening tabs. The fastening tabs are formed on the top of the metal shell and extend from the top into the space to tightly press against a plug connector. Each fastening tab has two connecting ends, a first section and a second section. The connecting ends are connected to the top of the metal shell. With the connecting ends connected to the metal shell instead of free ends, the fastening tabs would not inadvertently extend out of the metal shell.

7 Claims, 6 Drawing Sheets

CONNECTOR WITH FASTENING TABS

BACKGROUND OF THE INVENTION

1. Field of the Invention

The present invention relates to a connector, and more particularly to a connector that has a shell with fastening tabs and prevents the fastening tabs from inadvertently extending out of the metal shell.

2. Description of Related Art

A conventional socket connector has an insulative housing, a plurality of terminals and a metal shell. The terminals are mounted in the insulative housing. The metal shell covers the insulative housing. To allow the conventional socket connector to connect tightly to a plug connector, the metal shell has fastening tabs being, capable of pressing tightly the plug connector. Each fastening tab is made by stamping the metal shell with a U-shaped cut to form an U-shaped outer edge of the fastening tab so that the fastening tab has a connecting end connected to the metal shell and a free end separated from the metal shell.

However, the connectors are designed more and more compact so that the fastening tabs with U-shaped outer edges would be curved easily out from the metal shell to fail and interfere with neighbor electronic components after repeatedly connecting the plug connector to and detaching the plug connector from the socket connector. Furthermore, the fastening tabs are too short to provide sufficient resilient force.

To overcome the shortcomings, the present invention provides a connector with fastening tabs to mitigate or obviate the aforementioned problems.

SUMMARY OF THE INVENTION

The main objective of the invention is to provide a connector that has a shell with fastening tabs and prevents the fastening tabs from inadvertently extending out of the metal shell.

A connector in accordance with the present invention comprises an insulative housing, a plurality of terminals and a metal shell. The insulative housing has a base and a tongue formed on the base. The terminals are mounted in the insulative housing. The metal shell covers the insulative housing and has a top, a space and a plurality of fastening tabs. The fastening tabs are formed on the top of the metal shell and extend from the top into the space to tightly press against a plug connector. Each fastening tab has two connecting ends, a first section and a second section. The connecting ends are connected to the top of the metal shell. With the connecting ends connected to the metal shell instead of free ends, the fastening tabs would not inadvertently extend out of the metal shell.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
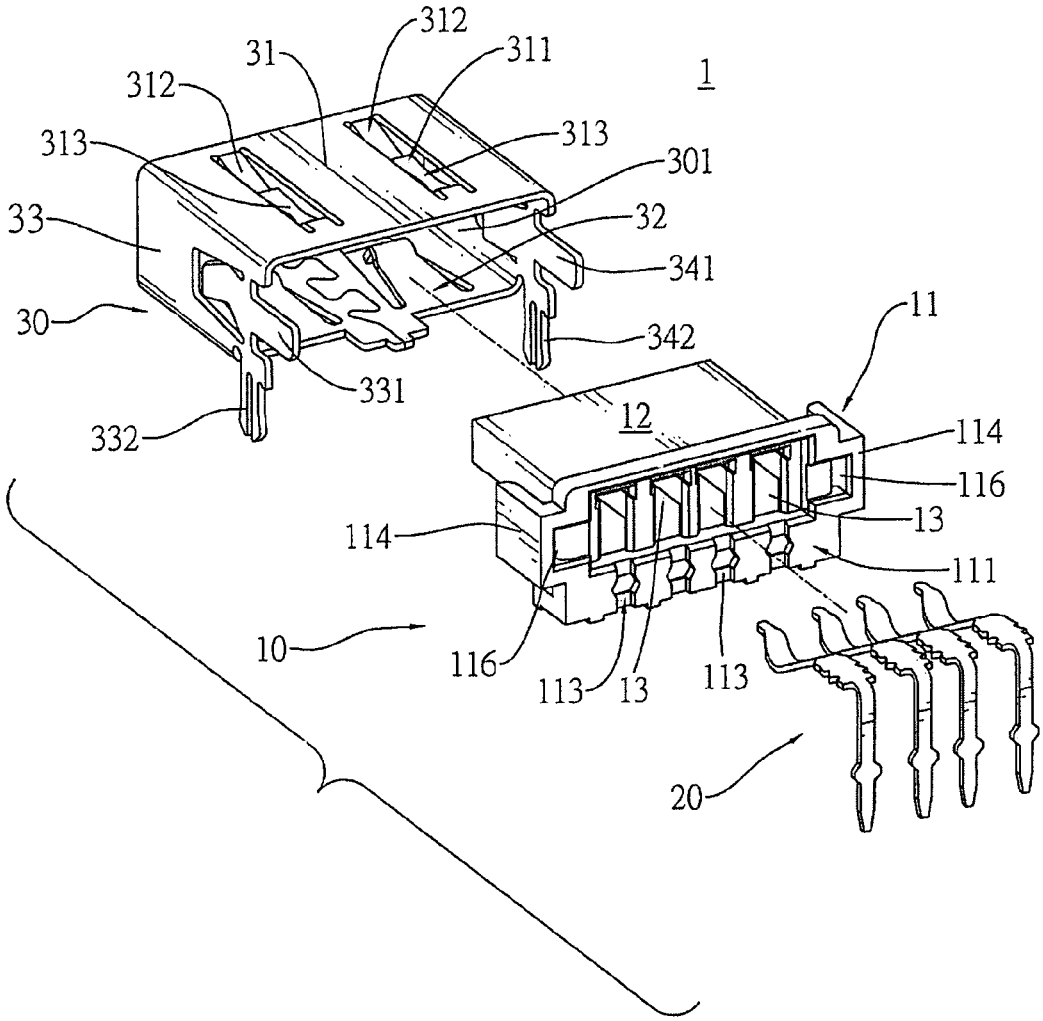
FIG. 1 is an exploded perspective view of a connector in accordance with the present invention.
Figure 2:
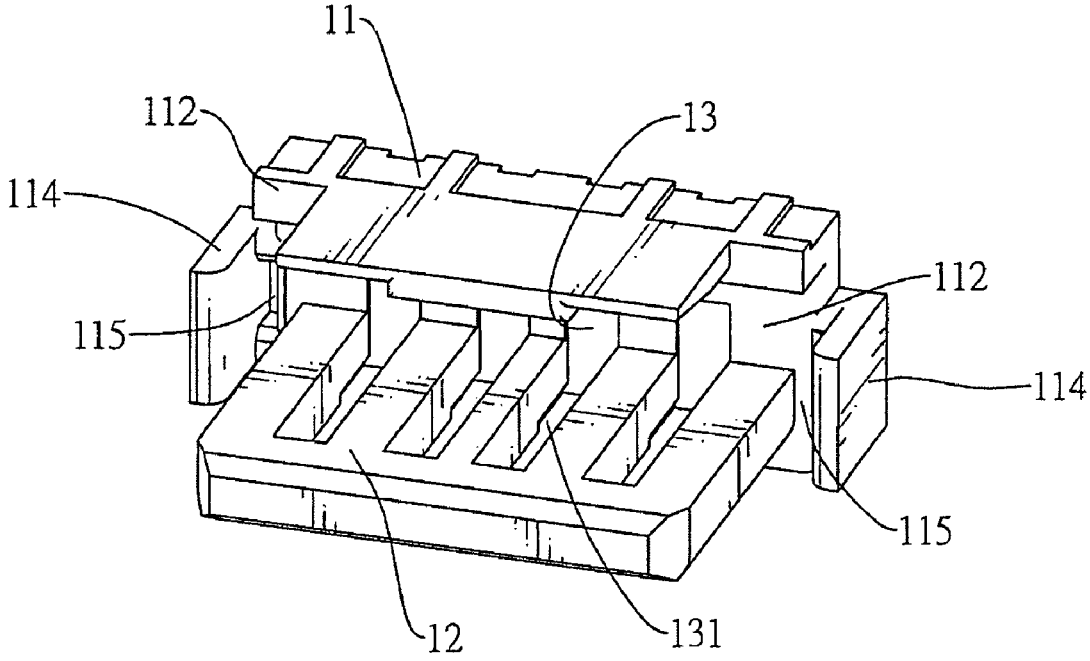
FIG. 2 is a perspective view of the insulative housing of the connector in FIG. 1.
Figure 6:
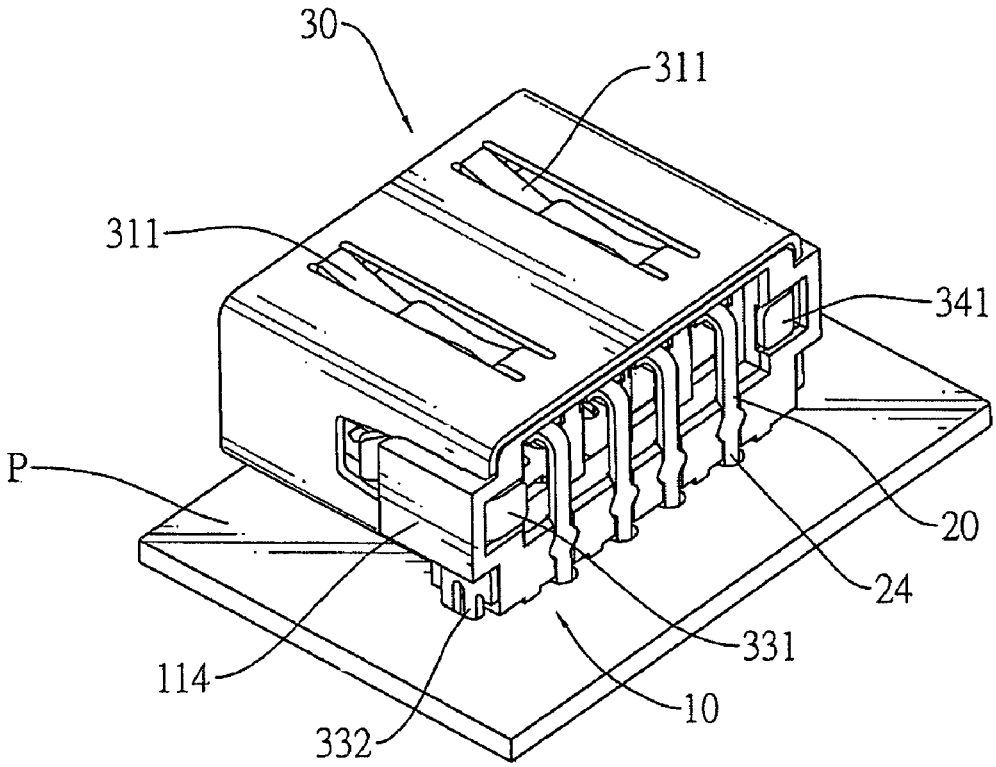
FIG. 6 is an operational perspective view of the connector in FIG. 5 mounted on a printed circuit board with the mounting hooks bent into L-shaped forms to hook the insulative housing.

With reference to FIGS. 1, 2 and 6, a connector (1) in accordance with the present invention may be a socket connector, may be mounted securely on a printed circuit board (PCB) (P) and comprises an insulative housing (10), a plurality of terminals (20) and a metal shell (30).

The insulative housing (10) has a base (11), a tongue (12) and a plurality of mounting holes (13) and may further have a plurality of positioning slots (113), two opposite wings (114) and two through holes (116).

The base (11) has a front (112), a rear (111) and two opposite sides.

The tongue (12) is formed on and protrudes from the front (112) of the base (11) and has a top and a bottom.

The mounting holes (13) are defined longitudinally through the base (11) and into the tongue (12) and each mounting hole (13) has an inner surface and a groove section (131). The groove section (131) is defined in the bottom of the tongue (12).

The positioning slots (113) are defined in the rear (111) of the base (11) and correspond respectively to the mounting holes (13).

The wings (114) are formed respectively on and protrude forwards from the sides of the base (11) and each wing (114) defines an interval (115) between the tongue (12) and the wing (114).

The through holes (116) are defined through the base (11) adjacent respectively to the sides and communicate respectively with the intervals (115).

Figure 3:
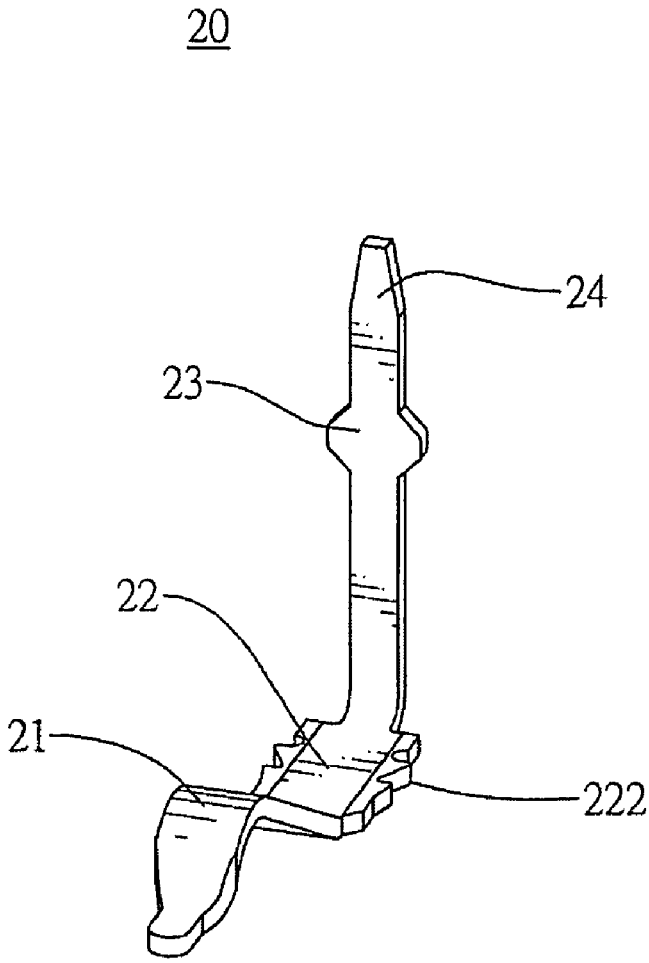
FIG. 3 is a perspective view of a terminal of the connector in FIG. 1.

With further reference to FIG. 3, the terminals (20) correspond respectively to and are mounted respectively in the mounting holes (13) and each terminal (20) has a mounting portion (22), a contacting portion (21) and a soldering portion (24) and may further have a positioning portion (23).

The mounting portion (22) is mounted securely in a corresponding mounting hole (13) and may have a plurality of teeth (222). The teeth (222) are formed on the mounting portion (22) and stab the inner surface of the corresponding mounting hole (13) to securely hold the mounting portion (22) in the corresponding mounting hole (13).

The contacting portion (21) is resilient, is formed on and protrudes forwards from the mounting portion (22) and is mounted in the groove section (131) of the corresponding mounting hole (13) in the tongue (12). The contacting portion (21) may contact a contact of a plug connector corresponding to the socket connector of the present invention to implement the power and signal transmission.

The soldering portion (24) is formed on and protrudes perpendicularly from the mounting portion (22) opposite to the contacting portion (21), extends out of the rear (111) of the base (11) and may be soldered on the PCB (P).

The positioning portion (23) is formed on and protrudes transversely from the soldering portion (24) and is engaged with one of the positioning slots (113) to hold the soldering portion (24) on the rear (111) of the base (11).

Figure 4:
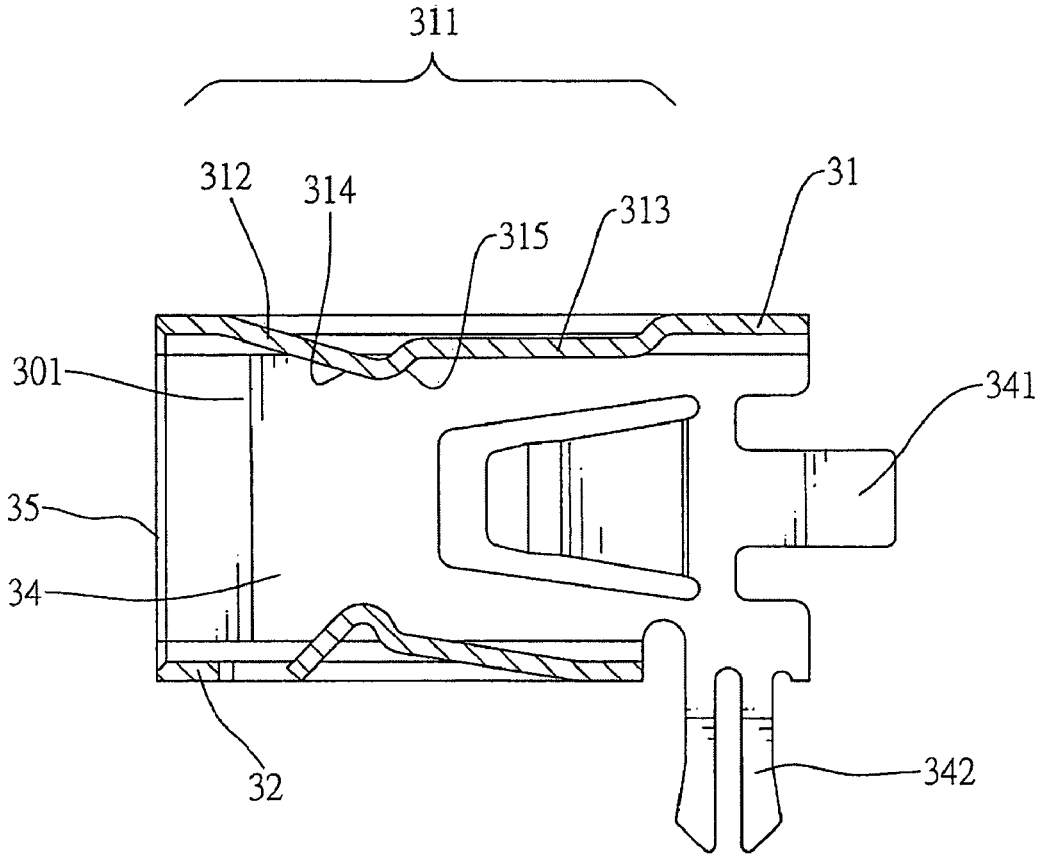
FIG. 4 is a cross sectional side view of the metal shell of the connector in FIG. 1.
Figure 5:
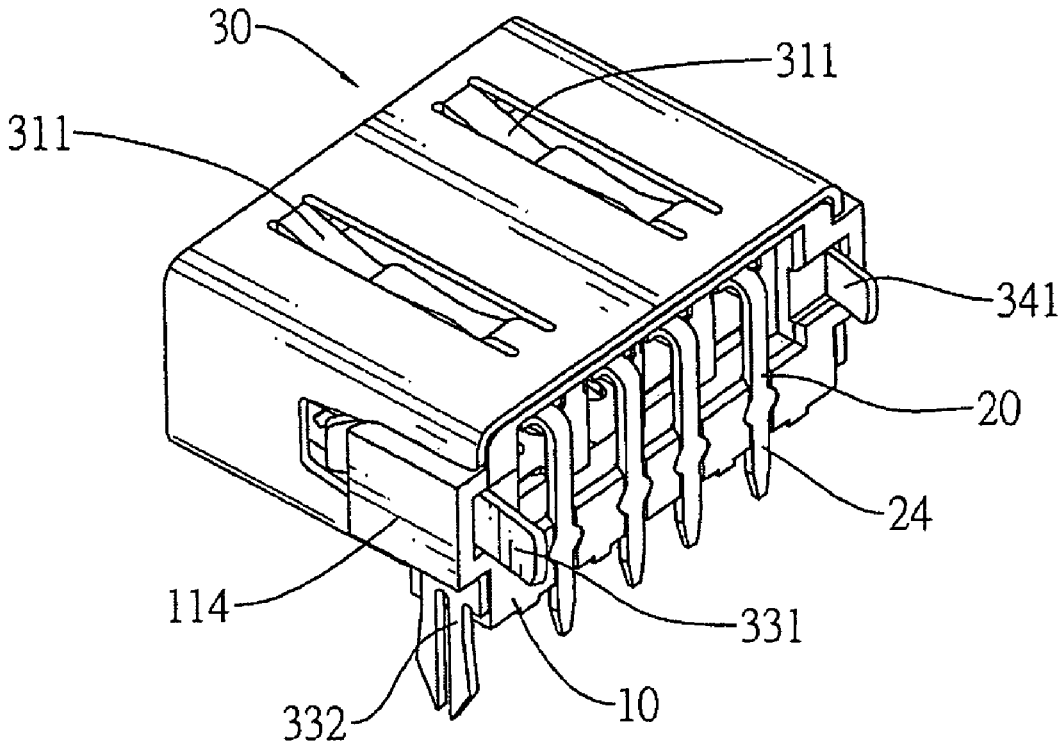
FIG. 5 is a perspective view of the connector in FIG. 1 with the mounting hooks of the metal shell being straight.

With further reference to FIGS. 4 and 5, the metal shell (30) covers the insulative housing (10) and has a top (31), a bottom (32), a front (35), two opposite sides (33, 34), a space (301)

and a plurality of fastening tabs (311) and may further have two mounting hooks (331, 341) and two mounting legs (332, 342).

The space (301) is defined in the metal shell (30), is surrounded by the top (31), the bottom (32) and the sides (33, 34) and accommodates the insulative housing (10).

The fastening tabs (311) are longitudinal and resilient, are formed on the top (31) of the metal shell (30) by stamping the metal shell (30) and extend from the top (31) into the space (301) to tightly press against the plug connector that is engaged with the space (301). Each fastening tab (311) has two connecting ends, a first section (312) and a second section (312).

The connecting ends of the fastening tab (311) are fixed ends and are connected securely to the top (31) of the metal shell (30). Therefore, the fastening tab (311) is mounted securely on the top (31) and would not inadvertently sway, curve or deform when compared to a conventional fastening tab having a connecting end and a free end.

The first section (312) is hook-shaped and inclined relative to the top (31) of the metal shell (30), is formed on and protrudes from the top (31) towards the space (301) and may have a first inclined segment (314) and a second inclined segment (315). The first inclined segment (314) is formed on the top (31) of the metal shell (30) and extends towards the space (301). The first inclined segment (324) contacts and smoothly guides the plug connector when the plug connector moves into the space (301) of the metal shell (30) from the front (35). The second inclined segment (315) protrudes upwards from the first inclined segment (314) with an obtuse included angle defined therebetween and extends towards the top (31) of the metal shell (30).

The second section (313) is formed on and protrudes from the top (31) of the metal shell (30) towards the space (301) and is connected to the second inclined segment (315) of the first section (312).

The mounting hooks (331, 341) are L-shaped, are formed respectively on and protrude backwards from the sides (33, 34), are mounted respectively through the through holes (116) of the insulative housing (10) and hook on the rear (111) of the base (11) to prevent insulative housing (10) from falling out of the metal shell (30). The mounting hooks (331, 341) are semi-finished and straight before extending through the through holes (116). After extending the through holes (116), the mounting hooks are bent to L-shape to hook on the insulative housing (10).

The mounting legs (332, 342) are compressible, are formed respectively on and protrude downwards from the sides (33, 34) of the metal shell (30) and are mounted respectively into mounting bores in the PCB (P) to securely hold the metal shell (30) on the PCB (P). Each mounting leg (332, 342) may have two parallel tabs formed with a gap therebetween so that the fitting the mounting leg (332, 342) into the mounting bore temporarily reduces the gap and allows the mounting leg (332, 342) to easily pass through the mounting bore. Furthermore, the mounting legs (332, 342) may be soldered on the PCB (P).

Because the connecting ends of each fastening tab (311) are connected to the top (31) of the metal shell (30) instead of free ends, the fastening tabs (311) would not inadvertently extend out of the metal shell (30) to contact and interfere with other electronic components on the PCB (P).

Furthermore, the fastening tabs (311) with the fixed connecting ends of the fastening tabs (311) are mounted securely on the metal shell (30) and would not inadvertently sway, curve or deform. When compared to a conventional fastening tab having a connecting end and a free end, the fastening tabs (311) of the present invention are more structurally firm and durable. Also, the fastening tabs (311) provide larger resilient forces to efficiently and stably hold the plug connector when compared to the conventional fastening tabs.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector comprising:

an insulative housing having a base having a front, a rear and two opposite sides;

a tongue formed on and protruding from the front of the base and having a top and a bottom; and a plurality of mounting holes defined longitudinally through the base and into the tongue and each mounting hole having an inner surface and a groove section defined in the bottom of the tongue;

a plurality of terminals corresponding respectively to and mounted respectively in the mounting holes and each terminal having a mounting portion mounted securely in a corresponding mounting hole;

a contacting portion being resilient, formed on and protruding forwards from the mounting portion and mounted in the groove section of the corresponding mounting hole in the tongue; and a soldering portion formed on and protruding perpendicularly from the mounting portion opposite to the contacting portion and extending out of the rear of the base; and a metal shell covering the insulative housing, having a top, a bottom, a front and two opposite sides and further having a space defined in the metal shell, surrounded by the top, bottom and the sides of the metal shell and accommodating the insulative housing; and a plurality of fastening tabs being longitudinal and resilient, formed on the top of the metal shell, extending from the top into the space and each fastening tab having two connecting ends connected securely to the top of the metal shell;

a first section being hook-shaped and inclined relative to the top of the metal shell and formed on and protruding from the top towards the space; and a second section formed on and protruding from the top of the metal shell towards the space and connected to the first section.

2. The connector as claimed in claim 1, wherein each terminal further has a plurality of teeth formed on the mounting portion and stabbing the inner surface of the corresponding mounting hole to securely hold the mounting portion in the corresponding mounting hole.

3. The terminal as claimed in claim 2, wherein the insulative housing further has a plurality of positioning slots defined in the rear of the base and corresponding respectively to the mounting holes; and each terminal further has a positioning portion formed on and protruding transversely from the soldering portion and engaged with one of the positioning slots.

4. The connector as claimed in claim 3, wherein the first section of each fastening tab of the metal shell has a first inclined segment formed on the top of the metal shell and extending towards the space; and a second inclined segment protruding from the first inclined segment, extending towards the top of the metal shell and connected to the second section.

5. The connector as claimed in claim 4, wherein an obtuse included angle is defined between the first inclined segment and the second inclined segment of the first section of each fastening tab.

6. The connector as claimed in claim 5, wherein the insulative housing further has two opposite wings formed respectively on and protruding forwards from the sides of the base and each wing defining an interval between the tongue and the wing; and two through holes defined through the base adjacent respectively to the sides and communicating respectively with the intervals; and the metal shell further has two mounting hooks being L-shaped, formed respectively on and protruding backwards from the sides of the metal shell, mounted respectively through the through holes of the insulative housing and hooking on the rear of the base.

7. The connector as claimed in claim 6, wherein the insulative housing further has two mounting legs being compressible and formed respectively on and protruding downwards from the sides of the metal shell.

* * * * *